United States Patent [19]

Hardt

[11] 4,035,008

[45] July 12, 1977

[54] AUTOMATIC PROTECTION DEVICE FOR A ROLLER BLIND AGAINST UNAUTHORIZED RAISING

[76] Inventor: Walter Hardt, Hauptstrasse, Hilgert, Germany, 5411

[21] Appl. No.: 662,813

[22] Filed: Mar. 1, 1976

[30] Foreign Application Priority Data

Dec. 5, 1975 Germany ..... 2554667
Mar. 3, 1975 Germany ..... 7506593[U]

[51] Int. Cl.[2] ..... E05C 21/00

[52] U.S. Cl. ..... 292/227; 292/345; 160/220

[58] Field of Search ..... 292/227, 345, DIG. 49; 160/220, 133

[56] References Cited

U.S. PATENT DOCUMENTS

| | | | |
|---|---|---|---|
| 3,302,692 | 2/1967 | Grau | 160/133 |
| 3,659,886 | 5/1972 | Andrews | 292/78 |
| 3,847,423 | 11/1974 | Gley | 292/113 |
| 3,850,465 | 11/1974 | Hill et al. | 160/133 |

*Primary Examiner*—Richard E. Moore
*Attorney, Agent, or Firm*—Herbert L. Lerner

[57] ABSTRACT

An automatic protection device for a roller blind to prevent unauthorized raising of the blind from the outside by means of two-arm toggle joints whose lever ends are linked at one of the adjacent roller blind staves so that upon unauthorized raising the free toggle joint moves against the flange of U-shaped guide channel in combination with a compensating member in the face region of the upper roller blind stave and movable relative thereto exerts on the locking teeth of the free toggle joint through the action of an additional force means such as an elastic compressible material, a pressure by which the locking teeth are brought against the flange of the guide channel. This not only assures positive locking but also acts to compensate for differences in stave spacings and widths of guide channels thereby reducing manufacturing and inventory costs.

10 Claims, 16 Drawing Figures

AUTOMATIC PROTECTION DEVICE FOR A ROLLER BLIND AGAINST UNAUTHORIZED RAISING

This invention relates to roller blinds and more particularly refers to a new and improved automatic protection device for preventing unauthorized raising of the roller blind from the outside.

Roller blinds are known in the art and are sold commercially with varying stave spacings and varying guide channels. A toggle joint locking device for roller blinds described in German Auslegeschrift No. 2,307,937 met with some success. Unfortunately locking did not occur under all conditions. Further the roller blinds with differences in stave spacings and widths of guide channels each required a different locking member adapted for such differences and this complicated manufacture and necessitated a large inventory.

In a device for the protection of safety devices against unauthorized raising of a roller blind shield of hollow profile bars, locking members protrude perpendicularly to the plane of the roller blind shield from the end face regions of the bars and come into functional connection with at least one flange of the respective U-shaped guide rail.

An attempt to push the roller blind shield up increases the pressure action of the teeth and secures the roller blind. The roller blind shield can be opened only by pulling up. Thereby, the locking member is automatically disengaged from the guide rail.

Through the application of force, the connection of the strap with the respective roller blind bar can be destroyed, so that the mounting for the safety device loses the necessary connection with the roller blind bars.

One might also attempt to push the roller blind shield inward from the outside, in order to reduce or cancel thereby the action of the locking teeth. With the large number of roller blinds bars of different design, such an attempt could be successful if the roller blind bar has a straight inside surface and lies loosely in the guide rail.

In the German Pat. No. 2,140,237, it was already provided to protect the locking members by attaching them at the upper bars of the roller blind shield or at different heights in such a manner that their attachment is not readily visible.

In the German Pat. No. 2,307,937, it was further proposed to fasten the mounting for the safety members at the respective roller blind bar by means of a strap.

An object of the present invention is to provide an automatic protection device against unauthorized raising of roller blinds with positive means to assure locking of the roller blind.

Another object of the invention is to provide an automatic protection device against unauthorized raising of roller blinds suitable for use with different stave spacings as well as for different widths of guide channels.

A further object of the invention is to protect the safety devices themselves by preventing the profile bars which contain the safety devices from separating by the application of force from the outide. In particular, the upper one of the two profile bars which contain the safety devices, should be prevented from separating from the lower profile bar by pushing it up.

In accordance with the invention positive locking and flexibility are provided by an automatic protection device for a roller blind against unauthorized raising from the outside, by means of locking members which are disposed in the end face regions of adjacent roller blind staves and are designed as two-arm toggle joints, and whose two lever ends are linked at one of the adjacent roller blind staves in such a manner that, when the closed position of the roller blind shield is reached, the free toggle joint of each locking member is moved against the flange or guide channels of approximately U-shaped cross section of the end face regions of the roller blind staves, while upon raising the roller blind shield, the toggle joint of each locking member is stretched, whereby the locking member can be moved out, perpendicularly to the plane of the roller blind shield, from the end face regions of the staves and can be brought into operative connection with at least one flange of the guide channel, the combination therewith of a compensating member arranged in said end face region of said adjacent roller blind staves and movable in said plane of said roller plane shield relative to said roller blind stave, and force means acting continuously on the upper pivot point of the upper level arm of said two-arm toggle joint to continuously urge said free toggle joint against guide channel.

The force means such as an elastic compressible material, particularly a spring, is preferably mounted in a holder and disposed between the top of the compensating member and the upper part of the holder.

In another embodiment of the invention, the straps, by which the mountings are attached on one side of the roller blind bar, are made as double straps which reach over the wall of the profile bars inside and outside, are connected with each other through the wall by screw connections and are secured in their position bars. The attachment of the safety device at the roller blind is thereby reinforced.

According to the invention, one embodiment has been found to be particularly advantageous by the feature that the strap which connects the mounting including the locking teeth with the wall of the roller blind bar, is formed at its outer end as a sliding bracket in such a manner and is given such dimensions that it prevents the locking teeth from being pushed away from the guide rail. This bracket is to be slidable so that it can slide at the inside of the U-shaped guide rail if the roller blind shield is actuated by the belt.

In a particular embodiment the locking teeth are provided with an additional bracing tooth, which prevents jamming of the roller blind when being raised, due to a possible faulty position of the locking teeth relative to the flange of the U-shaped guide rail.

It is particularly advantageous that a compensating member movably attached in the upper roller blind bar exerts on the locking teeth, through the action of an additional force, spring, wire or the like, via the upper linking point of the lever arm which acts on the locking member with the locking teeth, a pressure by which the locking teeth are brought toward the guide rail.

In a further embodiment of the invention, there is provided between the roller blind bars equipped with safety elements, one or several further profile bars or, on the roller blind bar containing the upper safety member, further roller blind bars are movably arranged, in which intermediate members establish or control the connection between the safety elements in the roller blind bars equipped with them. These intermediate members are guided, as are the safety members themselves, by straps at the further profile bars.

The use of such further roller blind bars provides further protection against the possibility that the locking teeth could be detached from the guide rail by forcible pushing-up.

A further protection against the forcible lifting of the locking teeth off the guide rail is provided by equipping the locking teeth with an electrically applied surface layer which contains chips of material, preferably corundum or the like, the hardness of which is greater than that of the surface in the U-rail. There are numerous embodiments for the design and shape of the U-rails. Among these is, in particular, also an anodized design which has a particularly hard and smooth surface. The hard chips applied to the locking teeth prevent sliding-off and penetrate the surface with certainty if force is used.

The anodized surface may be provided with protection against sliding at the locking point, for instance, by an applied coating which ensures a secure hold for the locking teeth.

The roller blind box itself is designed, according to the invention, in such a manner that its outer wall extends downward sufficiently far that it covers the safety devices attached at the upper bars. The roller blind bars equipped with the safety devices are thereby removed from sight as well as from the application of force.

On the protection device of the present invention a compensating member arranged in the end face region of the respective upper roller blind stave can be moved in the shielding plane of the roller blind shield relative to the roller stave, and acts continuously on the upper pivot point of the lever arm under the influence of force means such as a spring. The compensating member advantageously has a slot which runs in the shielding plane of the roller blind shield and in the slot is a guide pin fixed to a mounting. The compensating member acts on a lever arm of the toggle joint which, with its other lever arm, pushes the locking member out of the profiled bar and against the guide channel. The holder arrangement for the compensating member is advantageously of tubular design, so that the compensating member can move with a sliding motion up and down in the holder.

In this manner, the compensating linkage acts automatically on the toggle joint of two-arm design and via the latter, on the locking member which is pushed against the flange of a U-shaped guide channel. This causes a braking action against an attempted upward motion which braking action increases with an increase of the raising force so that it is most difficult and almost impossible to push the roller blind upward.

Through the action of the force means such as an elastic compressible material or spring, normal differences in spacing between the roller blind staves that may occur are bridged, and even wide guide channels are engaged at the inner flange with sufficient pressure so that any upward push of the roller blind from below increases the friction and prevents the opening. The locking member is disposed in a lower mounting of approximately U-shaped cross section in such a manner that it can be swung out of the end face regions of the lower stave between the free ends of the legs, perpendicularly to the plane of the roller blind shield. The tubular mountings, in which the compensating member and the locking member are guided, are advantageously fastened with a bracket each at the corresponding roller blind stave. This bracket preferably has an approximately L-shaped cross section.

For installing the protection device, two adjacent crosspieces are opened slightly. The mountings of the protection device are attached by means of bent-off ends of a bracket which is fastened flat on the roller blind stave. These brackets can be dimensioned so that they can be installed to the right as well as to the left and therefore only one type of bracket is needed.

A single model of the protection device of the present invention is adaptable and sufficient for any dimensions of roller blind staves and guide channels that normally occur. One and the same bracket, the same mounting, the same locking member and the same compensating member can be used for every protection device. These uniform parts permit ready installation of the protection device in any type of roller blind at the factory. The manufacturing and stocking of parts and attendant costs are reduced.

Other features which are considered as characteristic for the invention are set forth in the appended claims.

Although the invention is illustrated and described herein as embodied in automatic protection device for a roller blind against unauthorized raising, it is nevertheless not intended to be limited to the details shown, since various modifications may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 6A:
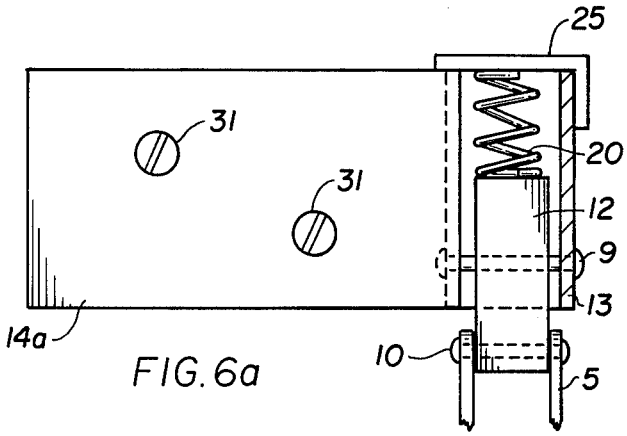
Figure 6B:
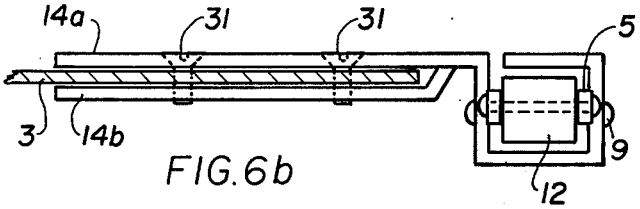

FIGS. 6*a* and 6*b* show in a top view the double strap 14*a*, 14*b* and in cross section in connection with the wall of the profile bar 3.

Figure 7A:
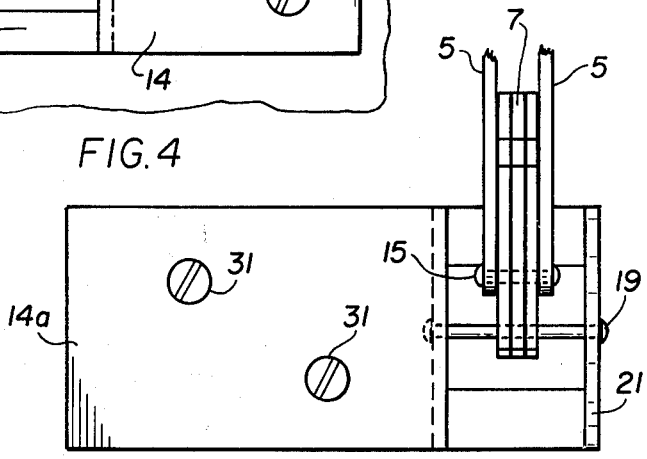
Figure 7B:
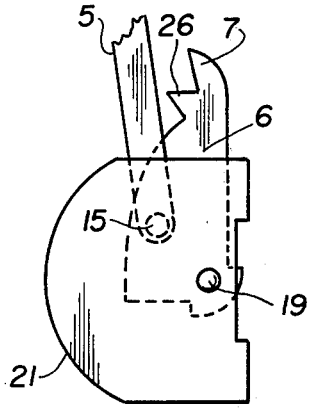
Figure 7C:
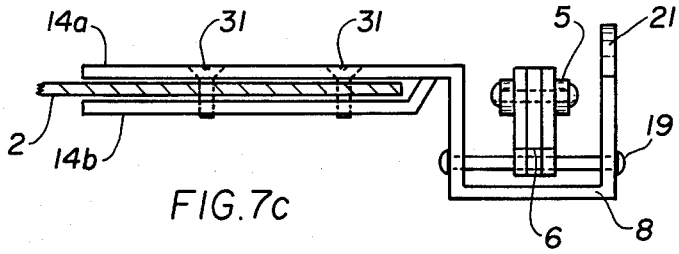

FIGS. 7*a* and 7*b* and 7*c* show in a top, front and side view the sliding bracket 21 at the end of the strap 14 with the locking tooth 7.

Figure 8A:
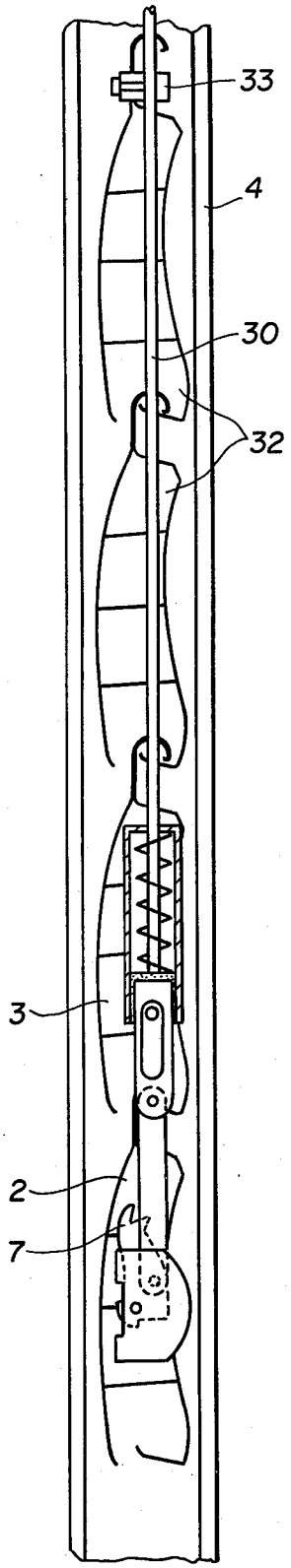
Figure 8B:
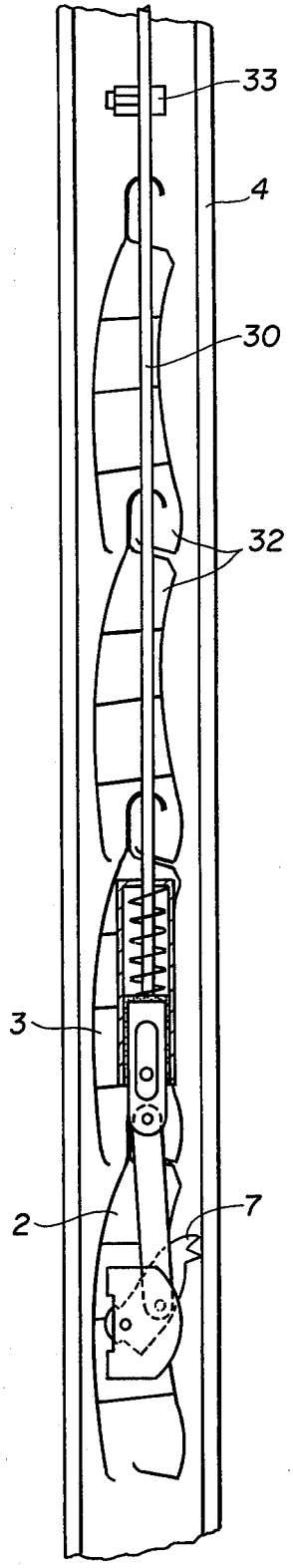

FIGS. 8*a* and 8*b* show in side view and partially in cross section, the profile bars 2, 3, 32 inside the guide rail with the spring wire 30.

Figure 9:
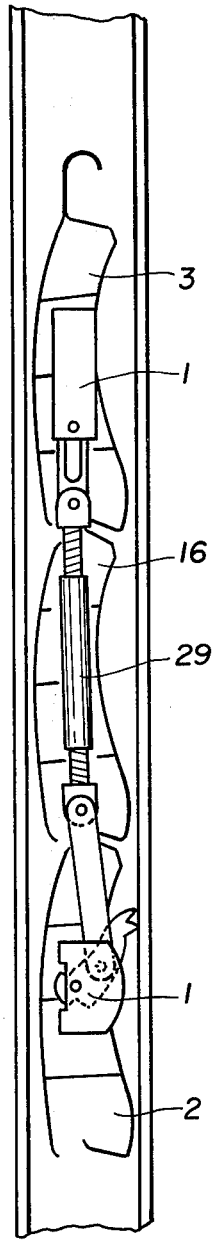
Figure 10:
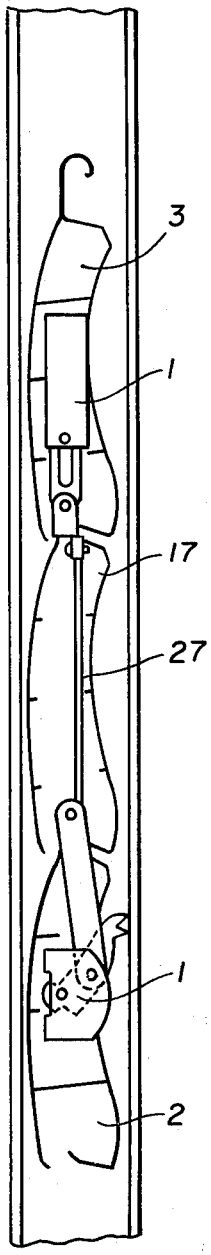
Figure 11:
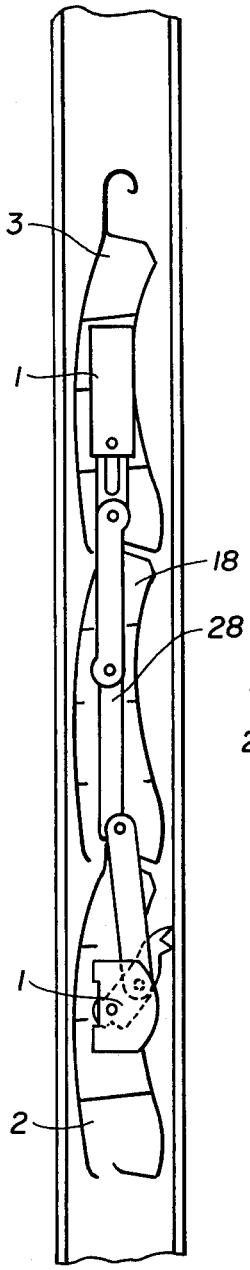

FIGS. 9, 10, 11 show, in side view, the attachment of a roller blind bar 17 between the roller blind bars 2, 3 with different compensation members 27, 28, 29.

Figure 12:
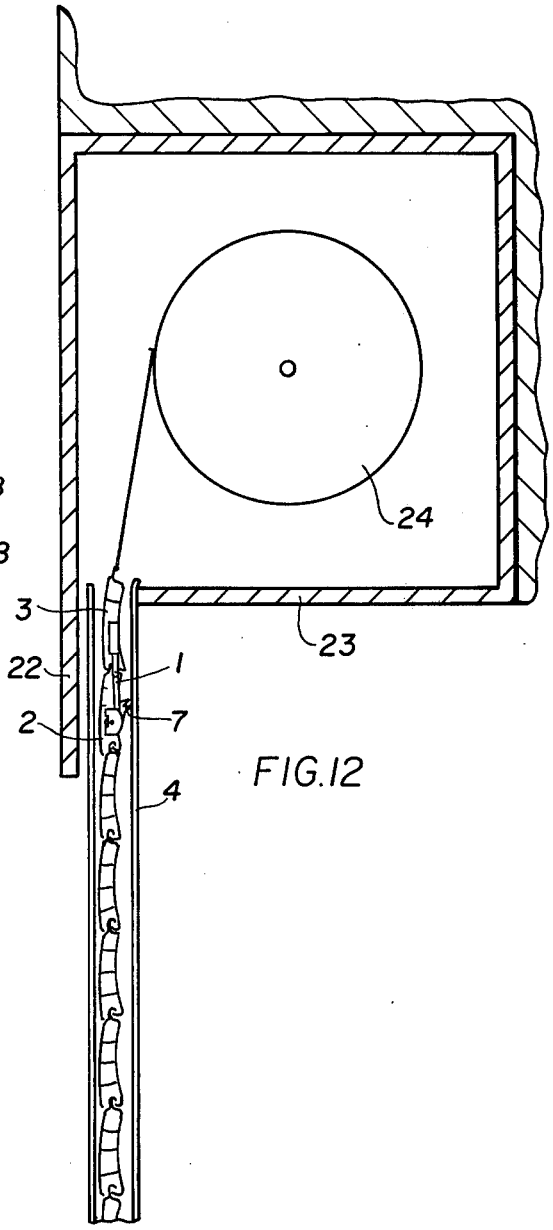

FIG. 12 shows in a side view the roller blind box 23 with an extended apron 22 for shielding the roller blind bars 2, 3.

The safety elements are in the roller blind bars 2, 3, which are connected together in the usual manner by joints.

Figure 1:
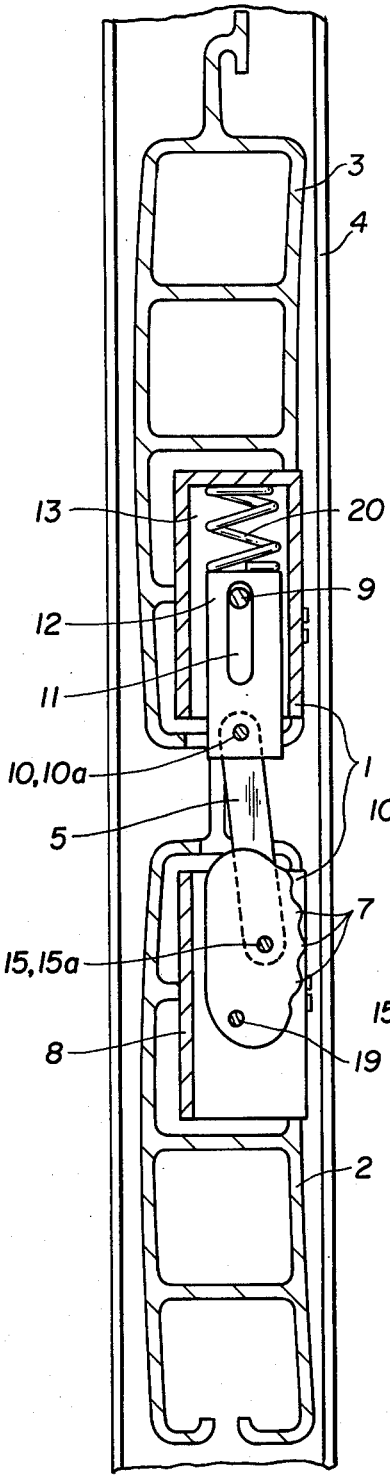
FIG. 1 shows a side view of a protective device, partially opened, in the rest position.
Figure 2:
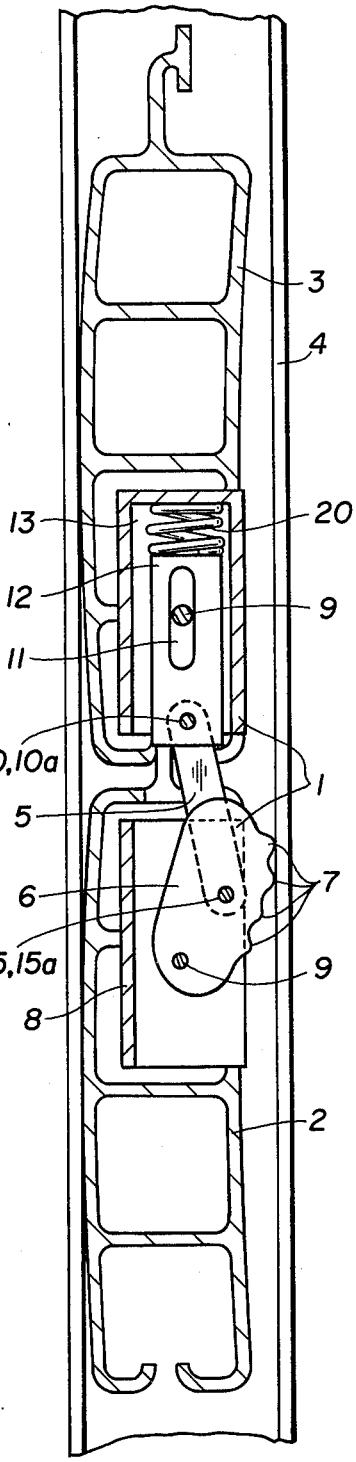
FIG. 2 shows the protection device according to FIG. 1 in the locked position.

Referring to FIGS. 1 and 2, protection device 1 is built into roller blind bars or stave 2, 3. The movable parts, namely compensating member 12, lever arm 5 and the locking member 6, are disposed in holder 8. These are rigidly connected at the upper roller blind stave 3 as well as at the lower roller blind stave 2 with a mounting bracket placed on the outside thereof.

The roller blind staves 2, 3 are positioned between the flanges 4 of a U-shaped guide channel. In FIG. 1 the roller blind staves 2, 3 are shown pulled apart and in FIG. 2, closed. In FIG. 2, the roller blind is shown at the instant when the lower stave 2 was lifted up from below. As a consequence, the compensating member 12 was lowered in the holder 8 due to the action of force means 20 which causes action by lever arm 5 on locking member 6 inducing the latter to emerge from the end face region of stave 2 and come into operative connection with flange 4 of the guide channel. Any suitable force means may be employed such as an elastic compressible material as for example, rubber, or a spring added to compensating member 12. Compensating member 12 provided in its upper part with a slot 11, in which guide pin 9 is located and establishes the connection with mounting 13.

In the lower part of the compensating member 12 there is a cutout 10, in which the upper part of the lever arm 5 is pivoted in the bearing 10*a*.

The lever arm 5 is pivoted at the upper part of locking member 6. The latter in turn is pivoted at the lower part by bearing 19, connecting it with lower holder 8.

While the compensating member 12 slides up or down only vertically, the lever arm 5 executes at the same time a swinging motion. The locking member 6 swings about fulcrum 19. The swinging motion is released if the roller blind stave 2 is pushed upward.

Figure 3:
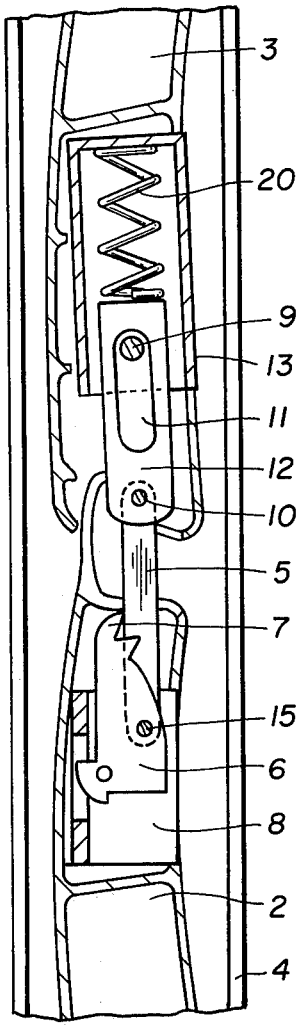
FIG. 3 shows a side view of another embodiment of the protective device with the roller blind bars 2, 3 in the U-shaped guide rail, partly opened, to show the safety elements.
Figure 5:
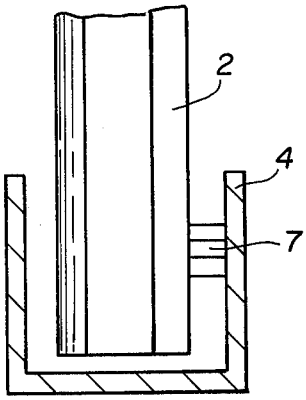
FIG. 5 shows a cross section through the guide rail with the flank 4, against which the teeth 7 of the locking members are pressed.

FIGS. 3 and 5 show how the roller blind bars are arranged in a U-rail and serve to guide the roller blind shield on both sides during raising and lowering. The flank 4 of the U-rail is provided to cooperate with the locking teeth 7 of the locking member 6 in such a manner that it is most difficult and almost impossible to raise the roller blind by pressure from below.

FIG. 3 shows the roller blind in the raised condition. In this condition, the roller blind bars 2, 3 are pulled apart.

Figure 4:
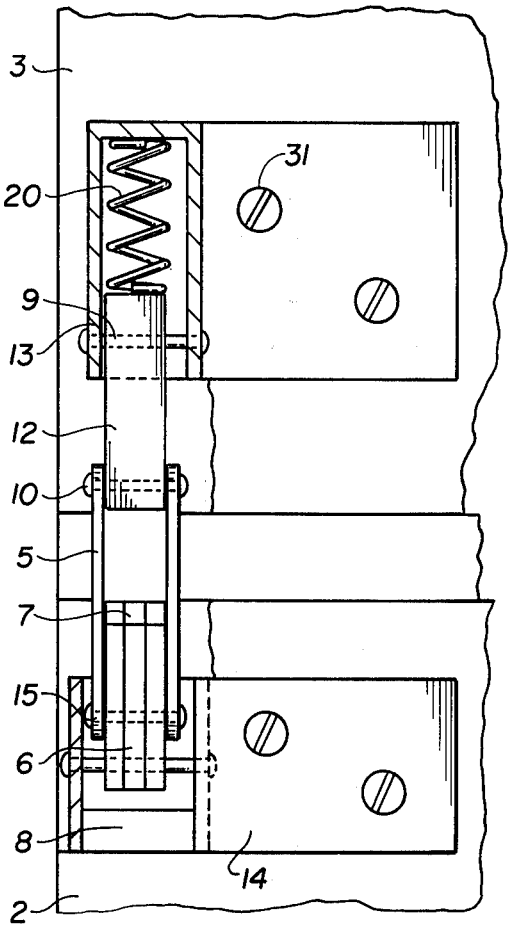
FIG. 4 shows in a top view the attachment of the safety elements at the roller blind bars 2, 3 by means of the double straps 14.

In the lower roller blind bar 2, there is located in a mounting 8 the locking member 6 equipped with the locking teeth 7. It is supported in a mounting 8 which forms the one end of a double strap 14, as shown in FIG. 4. The double strap 14 is firmly connected with the wall of the roller blind bar 2, around which it reaches on the inside and outside.

The safety elements of the roller blind bar 2 are connected with each other by a lever arm 5 set at an angle and are pivoted at the fulcrums 10, 15.

The safety element in the upper roller blind bar 3 consists of a compensating member 12. The latter is movably attached in the guide slot 11 by the guide pin 9 and is operated by the compression spring 20. The latter is braced against the cover 25.

These safety elements 1 are located in the mounting 13, which forms the outer end of the double strap 14, which is secured in its position, exactly like the lower strap 14, with the wall of the upper roller blind bar 3 by means of a screw connection. The screw connection is designated by numeral 31.

From FIG. 5, can be seen how the locking teeth 7 are directed against the flank 4 of the guide rail if the roller blind is lowered.

FIG. 6 shows the double strap 14*a*, 14*b* in top view as well as also from the side. The wall of the upper roller blind bar 3 is inserted into the double strap. The screw connection 31 goes through the double strap 14*a*, 14*b* and the wall 3.

FIG. 7 the double strap 14*a*, 14*b* is similarly firmly connected with the lower roller blind bar 2 via the screw connection 31. The safety elements 1 of the lower roller blind bar 2 are located in the outer end which is bent-off in U-fashion. The lower illustration shows in a side view an embodiment of the sliding bracket 21.

The locking tooth 7 is connected with a support tooth 26. The latter prevents the roller blind from jamming in the event that the locking teeth 7 lock due to a faulty position relative to the flange 4 of the U-rail when the roller blind is raised. Such faulty positions could result from a forcible attempt to push the roller blind up and also could prevent it from being raised. FIG. 8 shows another exmaple for preventing the roller blind from being pushed up forcibly. Above the upper profile bar 3, two additional roller blind bars 32 are provided.

A nylon thread 30 can slide through these in their longitudinal direction. A limiting screw 33 controls the separation of the roller blind bars during raising. This is shown in the picture to the left. The picture to the right shows the roller blind in the lowered condition. Here, the locking teeth 7 are set against the inside of the flange 4 of the U-shaped guide rail.

FIGS. 9 to 11 show another embodiment. Here, additional roller blind bars 16, 17, 18 are inserted between the roller blind bars 2, 3, which are equipped with the safety elements 1. The roller blind bar 16 is equipped with a threaded spindle 29 which allows adjustment to the width of the roller blind bar 16 used in each case. The roller blind bar 17 is penetrated by a springy sheet metal strip 27. This is a particularly simple and inexpensive embodiment of an intermediate member.

FIG. 10 shows the roller blind bar 18 with an additional lever arm 28.

The additional roller blind bars shown in FIGS. 8 to 11 form, with their different examples, a particular protection against the roller blind being pushed up forcibly, as they prevent in addition the locking teeth 7 from being disengaged from the flange 4 of the U-shaped guide rail, in an attempt to push the upper roller blind bars upward.

FIG. 12 shows in a cross section the roller blind box 23 with the winding roller 24. Its outer front is designed with an extended apron 22 in such a manner that the roller blind bars 2, 3, which contain safety devices 1, are not accessible from the outside. They are removed from sight as well as from forcible intervention.

There are claimed:

1. In an automatic protection device for a roller blind against unauthorized raising from the outside, by means of locking members which are disposed in the end face regions of roller blind bars and are designed as toggle joints, and whose two lever ends are linked in such a manner that, when the closed position of the roller blind shield is reached, the free toggle joint of each locking member is moved against guide channels of approximately U-shaped cross section of the end face regions of the roller blind bars, while upon raising the roller blind shield, the toggle joint of each locking membr is stretched, whereby the locking member can be moved out, perpendicularly to the plane of the roller blind shield, from the end face regions of the bars and can be brought into operative connection with at least one flange of the guide channel, the combination therewith of a compensating member arranged in said end face region of said roller blind bar and movable in said plane of said roller plane shield relative to said roller blind bar exerting on the free toggle joint through the action of an additional force means, a pressure urging said free toggle joint against said guide channel.

2. Automatic protection device according to claim 1, wherein said force means is an elastic compressible material.

3. Automatic protection device according to claim 1, wherein said force means is a spring.

4. Automatic protection device according to claim 2, wherein said elastic compressible material is mounted in a holder and disposed between the top of said compensating member and the upper part of said holder.

5. Device according to claim 1 wherein at least one further profile bar is movably attached between said roller blind bars on which are disposed said locking members, and in which intermediate members connect said locking members in said roller blind bars.

6. Device according to claim 1 wherein said free toggle joint has locking teeth in a mounting connected by a strap with the wall of said lower roller bar with the outer end of said strap forming a bracket to prevent said locking teeth from being pushed away from said guide rail.

7. Device according to claim 1, wherein locking teeth equipped with an additional support tooth are provided on said free toggle joint to the prevent the roller blind from jamming when being raised.

8. Device according to claim 1 wherein mountings for the locking members are fastened at the respective roller blind bar by means of straps, and wherein the straps are double straps which reach around a wall of said profile bars inside and outside and are connected with each other through the wall by screw connections and are secured in their position at the profile bars.

9. Device according to claim 1, wherein locking teeth on said free toggle joint are provided with an electrolytically applied surface layer which contains a material having a hardness greater than that of the surface of said guide rail.

10. Device according to claim 1 wherein a roller blind box into which the roller blind rolls has an outer wall extending downward a sufficient distance to cover said locking members attached at the upper roller blind bars.

* * * * *